United States Patent [19]

Paulini et al.

[11] Patent Number: 4,760,629

[45] Date of Patent: Aug. 2, 1988

[54] PROCESS FOR THE TREATMENT OF A FILAMENT CABLE

[75] Inventors: Dieter Paulini; Wolfram Wagner, both of Dormagen; Peter Schmitz-Bastian, Erftstadt-Liblar; Robert Brück, Erftstadt-Ahrem, all of Fed. Rep. of Germany

[73] Assignee: Bayer Aktiengesellschaft, Leverkusen, Fed. Rep. of Germany

[21] Appl. No.: 122,629

[22] Filed: Nov. 19, 1987

Related U.S. Application Data

[63] Continuation of Ser. No. 920,481, Oct. 17, 1986, abandoned.

[30] Foreign Application Priority Data

Nov. 2, 1985 [DE] Fed. Rep. of Germany ..... 3538871

[51] Int. Cl.[4] ..... D02G 1/16; D02G 1/20

[52] U.S. Cl. ..... 28/256; 28/281; 68/5 D

[58] Field of Search ..... 28/220, 221, 255, 256, 28/257, 266, 267, 273, 281, 289; 68/3 SS, 5 D

[56] References Cited

U.S. PATENT DOCUMENTS

| | | | |
|---|---|---|---|
| 2,986,912 | 6/1961 | Richeson et al. | 28/281 X |
| 3,188,713 | 6/1965 | Dyer et al. | 28/273 |
| 3,373,470 | 3/1968 | Joly | 28/255 |
| 3,457,602 | 7/1969 | Oatfield et al. | 28/281 |
| 3,526,024 | 9/1970 | Fay | 28/257 X |
| 4,019,228 | 4/1977 | Ozawa et al. | 28/221 |
| 4,169,707 | 10/1979 | Gloeckler | 28/281 X |

FOREIGN PATENT DOCUMENTS

| | | | |
|---|---|---|---|
| 79518 | 2/1971 | German Democratic Rep. | 28/257 |
| 46-37007 | 10/1971 | Japan | 28/266 |
| 595634 | 12/1947 | United Kingdom | 28/263 |
| 1129204 | 10/1968 | United Kingdom | 26/18.5 |

OTHER PUBLICATIONS

H20 02/1986 USSIR Nunn et al. (Statutory Invention Registration).

*Primary Examiner*—Robert R. Mackey

*Attorney, Agent, or Firm*—Spring Horn Kramer & Woods

[57] ABSTRACT

The treatment of a filament cable in a device into which it is introduced, in which it is crimped, treated with a gas, and withdrawn, characterized by the fact that the cable is crimped using a crimping device which is operated gas-dynamically, which has been mounted into the front face of a device for the treatment of the cable with a gas, and is thus introduced into this device in the manner of a sluice, and is folded using a slide with an S-shaped section onto a gas-permeable, horizontally transporting base as a crimping cake, is treated there with the gas, and is finally withdrawn from the device.

10 Claims, 1 Drawing Sheet

PROCESS FOR THE TREATMENT OF A FILAMENT CABLE

This application is a continuation of application Ser. No. 920,481, filed Oct. 17, 1986, now abandoned.

BACKGROUND OF THE INVENTION

The invention concerns a process for the treatment of a filament cable in a device into which it is introduced, crimped, trated with a gas and withdrawn.

Various kinds of filament cables must undergo drying, relaxing or thermosetting stages, in particular after washing, stretching or softening, in order to obtain a desired moisture content and particular values for properties such as expansion, strength or affinity for dyes. Moreover filament cables of this kind are usually crimped in order to prevent the filament cables from falling apart into individual threads and in order to attain, for the cut filaments, sufficient adhesion for the subsequent spinning process. The drying, relaxing and thermosetting stages are usually carried out by the treatment of the cable with a gas, especially with steam or heated air. Particular periods of direct contact must be adhered to for these steaming and drying processes.

In conventional subsequent treatment processes with low product rates of up to 150 m per minute and large band weights of, for example, 100 ktex, the required times of direct contact are attained with the aid of perforated drum dryers, which contain a row of perforated drums, for example, 20 to 30 drums with a diameter of 140 cm. The drying is carried out with heated air whereby air speeds of 3 to 5 m per second must be applied in order for adequate drying to be achieved. The energy requirement which is necessary for this process is very considerable. Since a residual solvent or a residual monomer is also always expelled from the filament cable during steaming and drying it is necessary for the drying devices to be closed to the surroundings which, however, is only partially successful in the case of a perforated drum dryer. The crimping is usually carried out after drying.

In continuous subsequent treatment processes which follow dry spinning processes, for example, with wind-off speeds of between 50 and 400 m per minute, speeds of, for example, 100 to 2000 m per minute arise, brought about by stretching. With these speeds and stretched product guiding such as is necessary on perforated drum dryers, the periods of direct contact required for drying cannot be achieved with realistic device sizes. For this purpose, what are termed "travelling filter dryers" are well-known on which the productd is piled up in a meandering shape with little tension and transported through the treatment areas in this way. The low tension, mostly tensionless piling-up on the travelling filter has the disadvantage that initially piled-up product layers of the folded cable drop down and are always covered by product layers which have been piled-up later, with the result that when the cable is unwound from the travelling filter a large proportion of the cable must be pulled out from underneath the rest of the cable. This can cause tangled layers, knotting, and thus problems in the progress of the process. In order to eliminate this disadvantage, the cable must be piled up on what are termed "turning drums" before introduction into the steaming or drying device and these drums ensure that when the cable is piled up onto the travelling filter, the product layers which are piled up first come to rest from above and can be unwound without any problems.

One disadvantage involved in this complicated technique is the fact that it is difficult to seal the device on the product inlet side with the result that large quantities of air are unnecessarily carried into the device and are included in the heating up, or harmful emissions emerge from the leaks. Furthermore, because of the turning drum the cable cools down and thus energy is lost.

SUMMARY OF THE INVENTION

It is the object of the invention to crimp filament cables with band weights of between 5 and 500 ktex which arrive at speeds of 100 to 2000 m per minute, in a manner which saves energy and does not cause much emission, and to steam and/or relax or dry and set these cables.

This object is fulfilled by the invention by the crimping of the cable using a gas-dynamically operated crimping device mounted into the front face of an installation for the treatment of the cable with a gas and thus introducing it into this installation in the manner of a sluice, and folding it using a slide with an S-shaped section onto a gas-permeable, horizontally transporting base as crimped cakes, treating it with the gas and finally withdrawing it from the installation.

The blow nozzles can be operated with steam or air at a suitable temperature. The front face into which it is mounted can at the same time be the end wall of a preceding device in which the product is, for example, washed, stretched or softened.

The installation for gas treatment can be divided into several treatment zones. In the individual treatment zones, the treatment medium, steam or air, is circulated in each case from a ventilator over a heat exchanger and the product is circulated in the cycle. In the case of cooling zones, there are no heat exchangers and fresh air is drawn in for cooling. If the installation is used as a dryer, a fresh air flow is superimposed on the internal circuits in reverse flow to the product. This fresh air flow cools the product in the cooling zones and is, itself heated up at the same time. When it flows through the dryer, it becomes loaded with moisture which has been taken out of the product and is drawn off in the first drying zone with the aid of a ventilator. If the installation is operated as a steamer, the crimping nozzle is also operated by steam, as would seem sensible. The crimping steam can then be used for steaming at the same time but must then be taken in parallel flow to the product. As a final process, cooling takes place here, too. The installation can also be sued for a combined steam and drying treatment whereby an intermediate zone is inserted, as would be advisable between the steaming and drying zones. At the end of the installation, there is an opening through which the cable is withdrawn from the installation and, if necessary, taken to another device, for example, a cutting device or a piling-up device.

The base which transports horizontally can be a travelling filter which is fully enclosed in the installation casing at least as far as the unwinding zone.

The horizontally transporting base can also be a vibrator conveyor (oscillating chute) onto which the slide with an S-shaped section can be fitted directly. The slide then vibrates with the vibrator conveyor. It is surprising that the crimping cake, which is fitted without tension onto the vibrator conveyor, is conveyed without the production of tangled layers of the cable if particular frequency and/or vibration amplitude ranges are adhered to, i.e. vibration amplitudes of 1 to 8 mm and frequencies of 10 to 20 Hz. One main advantage in the use of the vibrator conveyor is the fact that particularly good sealing of the installation is achieved and no rotating parts are present on which cable accumulations could build-up. However, even with a travelling filter, such air-tightness of the installation can be achieved that the gas treatment can be conducted with slightly low pressure without becoming uneconomical because the quantities of escaping air are too great. The consequence to this is that the treated and crimped band can be taken out at the end of the installation through a simple opening. In addition, because of the small quantities of escaping air, the effectiveness and cleanliness of the treatment gases are improved and a careful, uniform product treatment is ensured. Because of the crimping process, the stretched filament band is converted into a cake form which is buckled and which is round in cross-section, oval or four-cornered. The buckling factor, expressed as a relationship between the filament band speed and the cake speed, is between 2 and 25. In addition to this buckling factor, a piling-up factor is also defined as the relationship between the cake speed and the conveying speed of the transporting base. This amounts to 1 to 100. Because of the enormous slowing-up of the filament speed, conveying speeds of 0.5 to 5 m per minute can be attained and thus relatively small installations with long periods of direct contact of, for example, 2 to 15 minutes can be made. Because of the buckling and piling-up, covering thicknesses of between 1.5 and 20 kg per $m^2$ are successfully achieved. Because of this, careful and very uniform treatments with low gas speeds of 0.3 to 3 m per second are made possible.

A clean piling-up of the crimping band cake onto the horizontally transporting base is achieved, in particular, when the slide with an S-shaped section has an incline to horizontal of between 30° and 70°, principally of between 45° and 60°, and a transition radius at the upper and lower end of between 50 and 200 mm, preferably between 75 and 150 mm. In one preferred embodiment, the slide is arranged above the trajectory of the crimping band.

Several bands of greater band weight, for example, 100 ktex, are piled up in parallel using a slide which has been structured in a straight line diagonally over the working width, whereas a single band of, for example, 20 ktex is piled up using a slide in the shape of an arc which is variable in a meandering shape.

The gaseous medium, preferably steam or hot air, can flow through the gas-permeable, horizontally transporting base and the crimping band cake from the bottom upwards or from the top downwards.

The process according to the invention is suitable in principle for all types of filament cables, in particular, however, for those which are produced by the spinning of a spinning solution. The process according to the invention is particularly effective for the treatment of acrylic filament cables, preferably according to the dry spinning process.

DETAILED DESCRIPTION OF THE INVENTION

Figure 1:
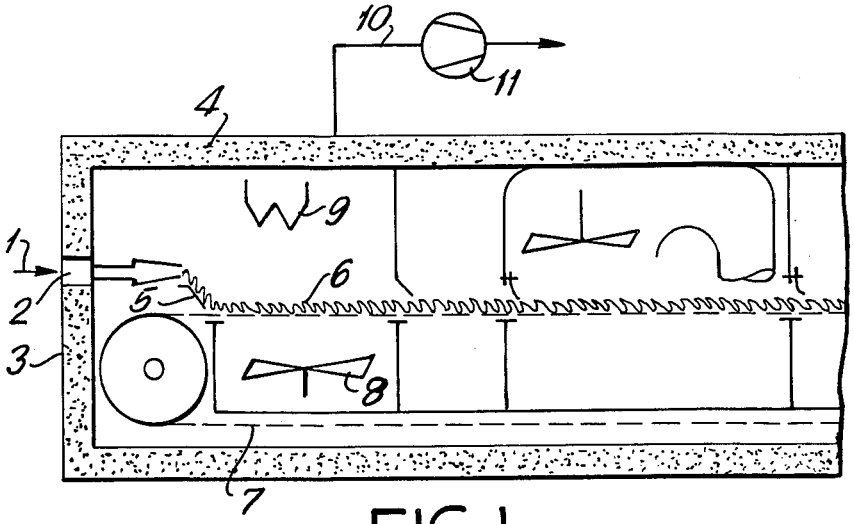
FIG. 1 is a longitudinal section of a device for carrying out the method of the present invention.

FIG. 1 shows a longitudinal section of a device in which the process according to the invention can be carried out. The product 1 is transferred into the installation through a gas-dynamic crimping device 2 which is mounted, gas-tight, in the front side 3 of the insulating case. Via the S-shaped slide 5, according to the invention,the crimping band cake is piled up into a travelling filter 7 which is included in the installation, in such a way that the cake can be unwound neatly after the treatment.

Fresh air is taken in through the product outlet opening (not shown) and blown from the ventilator 8 via the heat exchanger 9 onto the product. Outgoing air is taken away via the pipe 10, the ventilator 11 and a flap which can be adjusted (not shown).

Figure 2:
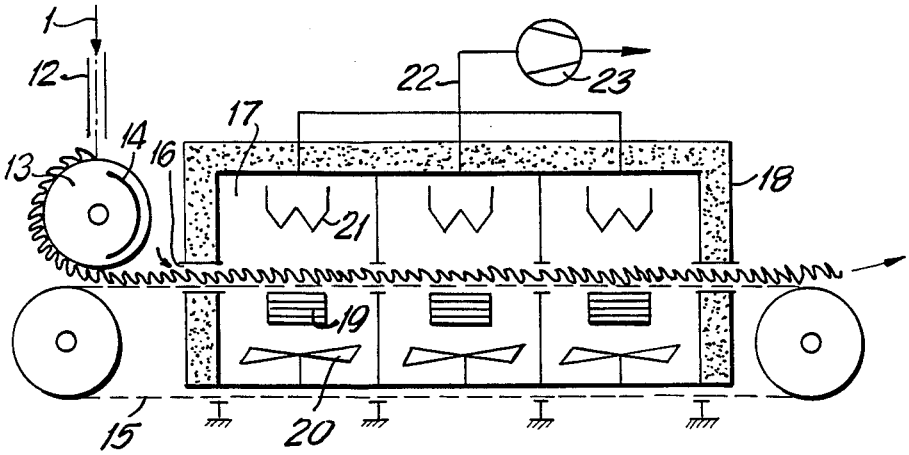
FIG. 2 (PRIOR ART)
FIG. 2 is a longitudinal section through a conventional travelling filter dryer.

FIG. 2 shows a longitudinal section through a well-known, standard travelling filter dryer. The product 1 is piled up onto the turning drum 13 with the aid of the mobile traversing device 12 which is in a vertical plane transversely to the flow direction of the product. Because of low pressure applied to the turning drum, the product sits close to this drum. Because of the partial screening 14 of the inside of the drum in the delivery area, the product goes over from the drum onto the travelling filter 15. This travelling filter transports the product through the opening 16 into the chambers 17 of the insulated casing 18. In order to prevent any tangling of the layers, the opening 16 must be appropriately large. Inside chambers 17, fresh air is taken in laterally through the flaps 19 which can be adjusted, and the air is blown from the ventilator 20 via the heat exchanger 21 onto the product. A partial flow is carried off out of each chamber via the pipe 22 of the common outgoing air ventilator 23.

EXAMPLE 1

Four polyacrylnitrile filament bands of 80 ktex each, of a moisture level of 45% by weight related to solids, of a width of 200 mm each, are each fed to a four-cornered crimping nozzle, operated by steam at 100 kg per hour, at a speed of 100 m per minute and at a temperature 100° C., crimped and piled up next to each other. Because of the buckling factor of 12.5 and a conveying speed of the travelling filter which has been adjusted to 4 m per minute, a folding factor of 2 and thus a covering of 10 kg/$m^2$ results. The slide which has been made with an S-shaped section slides over the crimping cake from the crimping nozzle onto the travelling filter, lies in a straight line transversely to the conveying direction and has an incline angle of 60° and a radius in the transition area of 125 mm. In a first zone of 2 m in length, the crimping steam is circulated at 110° C. and at 1.5 m per second from the top downwards, in product terms. In this process, the boiling shrinkage is reduced from 25 to 2%. In addition, the crimping cake is transported through the intermediate zone of 0.5 m into the seven drying zones of 2.5 m each, and is admitted with air of 140° C. and at 1.5 m per second here, and cooled in two subsequent cooling zones of 2.5 m each, to about 60° C. and unwound from an unwinding zone of 2 m and taken to a packaging unit. The material is fully shrunk and has a moisture content of 2%.

EXAMPLE 2

Figure 3:
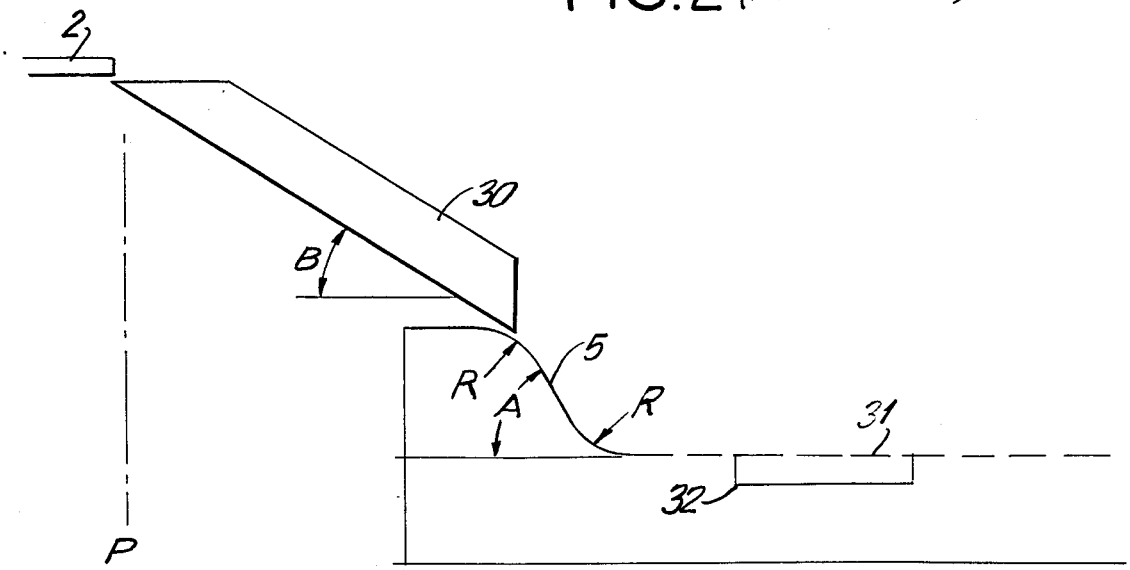
FIG. 3 is a detail of the device of FIG. 1 with a traversing device.

One filament band made of polyscrylonitrile of 10 ktex is fed to a round crimping nozzle which is operated with 120 kg per hour steam, at a speed of 1200 m per minute, a temperature of 100° C. and a moisture content related to solids of 50%. As shown in FIG. 3, the crimping cake is delivered to a traversing device 30 which is inclined at an angle B of 33° to the horizontal at its pivot point P, and from this installation is folded, using an arc-shaped slide 5 which is structured with an S-shaped section, with an incline A of 55° and a radius R of 100 mm in the transition area, onto a vibrator conveyor 31 of 750 mm working width and including a vibrator 32. The conveyor speed is 2 m per minute and the covering 8 kg/m$^2$. In the first zone, which is 2 m long, the crimping steam is circulated from the bottom upwards at 105° C. and at 1.2 m per second. After the intermediate zone of 0.5 m, eight drying zones of 2 m each follow, in which the air is circulated from the bottom upwards at 135° C. and with a falling speed of 1.2 to 0.7 m per second. The unwinding zone follows the two cooling zones, and from this zone the band is taken to a cutter. The product is completely shrunk and has a moisture content of 1.5%.

We claim:

1. In a process for the treatment of a filament cable in an installation into which it is introduced, in which the cable is crimped, treated with a gas, and withdrawn, the improvement wherein: the cable having a weight of between 5 and 500 ktex is introduced at a speed of 100 to 2000 m/min and is crimped using a gas-dynamically operated crimping device which has been mounted into a front face of the installation is introduced into the installation in the manner of a sluice, folded via a slide with an S-shaped section having an incline to the horizontal of between 30° and 70° and a transition radius at the upper and lower end of between 50 and 200 mm onto a gas-permeable, horizontally transporting base as a crimping cake with a buckling factor of 2 to 25 and a piling-up factor of between 1 to 100, treated with the gas and withdrawn from the installation.

2. A process according to claim 1, wherein the cable is treated with steam.

3. A process according to claim 1, wherein the gas-permeable, horizontally transporting base is a vibrator conveyor.

4. A process according to claim 3, wherein the vibrator conveyor is operated with vibration amplitudes of between 1 and 8 mm and frequencies of 10 to 20 Hz.

5. A process according to claim 1, wherein the gas treatment is carried out with a gas speed of 0.3 to 3 m per second.

6. A process according to claim 1, wherein the cable is an acrylic filament cable.

7. A process according to claim 1, wherein the cable is treated with air.

8. A process according to claim 1, wherein the gas-permeable horizontally transporting base is a travelling filter.

9. A process according to claim 1, wherein the installation is maintained gas-tight during treatment.

10. A process according to claim 1, wherein the installation comprises a series of zones and wherein the treatment steps are carried out in different zones.

* * * * *